US008100721B2

(12) United States Patent
Yan

(10) Patent No.: US 8,100,721 B2
(45) Date of Patent: Jan. 24, 2012

(54) COAXIAL CONNECTOR

(75) Inventor: Yuejun Yan, Shenzhen (CN)

(73) Assignee: Yantel Corporation, Shenzhen (CN)

( * ) Notice: Subject to any disclaimer, the term of this patent is extended or adjusted under 35 U.S.C. 154(b) by 0 days.

(21) Appl. No.: 13/194,988

(22) Filed: Jul. 31, 2011

(65) Prior Publication Data

US 2011/0281461 A1 Nov. 17, 2011

Related U.S. Application Data

(63) Continuation of application No. PCT/CN2010/070414, filed on Jan. 29, 2010.

(30) Foreign Application Priority Data

Feb. 1, 2009 (CN) ..... 2009 1 0006333

(51) Int. Cl.
*H01R 13/66* (2006.01)

(52) U.S. Cl. ..... 439/620.03

(58) Field of Classification Search ..... 439/578, 439/620.03

See application file for complete search history.

(56) References Cited

U.S. PATENT DOCUMENTS

| | | | | |
|---|---|---|---|---|
| 6,380,826 | B1 * | 4/2002 | Palinkas | 333/175 |
| 6,794,957 | B2 * | 9/2004 | Shafer et al. | 333/185 |
| 7,052,283 | B2 * | 5/2006 | Pixley et al. | 439/620.03 |
| 7,442,084 | B2 * | 10/2008 | Montena | 439/620.03 |

* cited by examiner

*Primary Examiner* — Tho D Ta

(74) *Attorney, Agent, or Firm* — Matthias Scholl P.C.; Matthias Scholl

(57) ABSTRACT

A coaxial connector including a first element, two metal joints, a first metal shell, a second metal shell, an elastic fixing member, and a pair of metal fixings. The first element includes a circuit substrate, a signal input terminal, a signal output terminal, and a grounding terminal and is sandwiched between the pair of the metal fixings. The elastic fixing member embraces the pair of the metal fixings. One end of each of the two metal joints contacts with the signal input terminal and the signal output terminal of the first element, respectively, and the other end thereof contacts with a signal terminal of the first metal shell and the second metal shell, respectively. The pair of the metal fixings each contacts with the inner conductor of the first metal shell and the second metal shell. The coaxial connector is applicable to different thicknesses of substrates, and is easy to assemble and disassemble.

12 Claims, 9 Drawing Sheets

COAXIAL CONNECTOR

CROSS-REFERENCE TO RELATED APPLICATIONS

This application is a continuation of International Patent Application No. PCT/CN2010/070414 with an international filing date of Jan. 29, 2010, designating the United States, now pending, and further claims priority benefits to Chinese Patent Application No. 200910006333.4 filed Feb. 1, 2009. The contents of all of the aforementioned applications, including any intervening amendments thereto, are incorporated herein by reference.

BACKGROUND OF THE INVENTION

1 . Field of the Invention

The invention relates to a coaxial connector for electronic and communications devices, and more particularly to a coaxial connector for high frequency and microwave circuits and systems.

2 . Description of the Related Art

Coaxial connectors have been widely used in RF devices and systems. In order to produce high accuracy attenuation and low reflection coefficient of coaxial attenuators, it is urgent to improve the internal structure of coaxial connectors.

Conventional coaxial fixed attenuator includes a hollow copper column in which an attenuator is disposed. The hollow copper column has two slots, and the attenuator is firmly fixed in the hollow copper column using two flexible beryllium copper gaskets.

To make high frequency range of attenuators, thin ceramic substrates are often employed. The higher the frequency range, the thinner the ceramic substrates should be, and thus the higher the production cost is. To meet different requirements on frequency range and price, the slots of the hollow copper column should be prepared with different thickness, which means the hollow copper column and gaskets need altering accordingly. Furthermore, common ground is very important for an attenuator, so the grounding terminal of parallel resistances should be the same. Conventional coaxial connectors are very difficult for assembling, and if the two slots in the hollow copper column are processed with errors, the grounding cannot be guaranteed. If assembled coaxial fixed attenuators are tested to have poor performance, the disassembling is unavoidable, which takes time and may destroy the attenuators. Besides the attenuators, other communications devices, such as wave filters, impedance converter, also have the above mentioned disadvantages.

SUMMARY OF THE INVENTION

In view of the above-described problems, it is one objective of the invention to provide a coaxial connector comprising a metal fixing that is easy to assemble and in which the metal fixing is practicable for different thickness of substrates.

To achieve the above objective, in accordance with one embodiment of the invention, there is provided a coaxial connector comprising a first element, two metal joints, a first metal shell, a second metal shell, an elastic fixing member, and a pair of metal fixings, wherein the first element comprises a circuit substrate, a signal input terminal, a signal output terminal, and a grounding terminal and is sandwiched between the pair of metal fixings, and the grounding terminal contacts with the pair of metal fixings; the elastic fixing member embraces the pair of metal fixings; one end of each of the two metal joints contacts with the signal input terminal and the signal output terminal of the first element, respectively, and the other end thereof contacts with a signal terminal of the first metal shell and the second metal shell, respectively; and the pair of metal fixings both contact with an inner conductor of the first metal shell and the second metal shell.

Advantages of the invention are summarized below. The pair of metal fixings of the coaxial connector is suitable for different thickness of substrates, thereby reducing the stocks of elements. The assembling and disassembling of the device is easy, the grounding is secure, and thus high accuracy and high electrical performance of coaxial connectors are achieved. The device is particularly suitable for the preparation of fixed attenuator with different frequency range.

BRIEF DESCRIPTION OF THE DRAWINGS

The invention is described hereinbelow with reference to accompanying drawings, in which.

DETAILED DESCRIPTION OF THE EMBODIMENTS

For further illustrating the invention, experiments detailing a coaxial connector are described below. It should be noted that the following examples are intended to describe and not to limit the invention.

Figure 1:
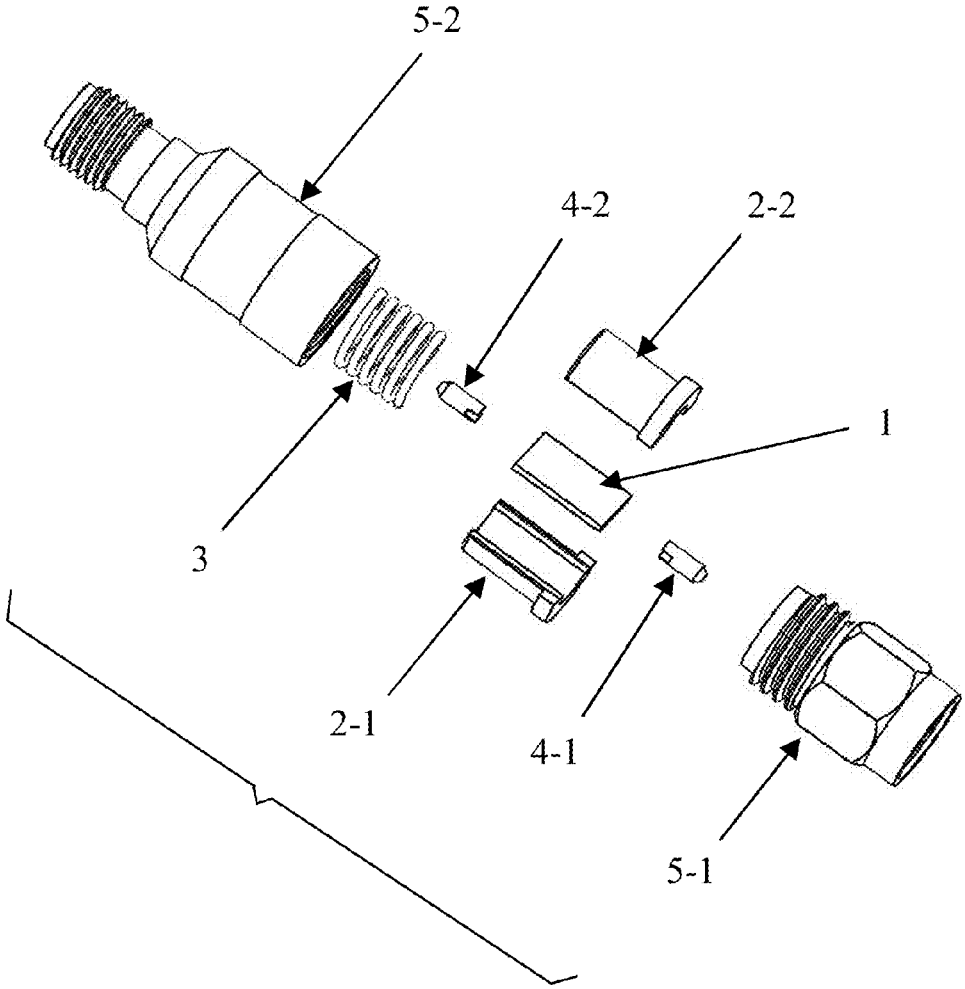
FIG. 1 is an exploded view of a coaxial connector according to one embodiment of the invention.

As shown in FIG. 1, an exploded view of a coaxial connector according to one embodiment of the invention. The coaxial connector comprises a first element 1, a pair of metal fixings 2-1, 2-2, an elastic fixing member 3, two metal joints 4-1, 4-2, a first metal shell 5-1, and a second metal shell 5-2.

The first element 1 may be an attenuator, a wave filter, an impedance converter, or something like that. The first element 1 comprises a circuit substrate, a signal input terminal, a signal output terminal, and a grounding terminal. One end of each of the two metal joints 4-1, 4-2 contacts with the signal input terminal and the signal output terminal of the first element 1, respectively. The first element 1 is sandwiched between the pair of metal fixings 2-1, 2-2. The grounding terminal of the first element 1 contacts with the pair of metal fixings 2-1, 2-2. The elastic fixing member 3 embraces the pair of metal fixings 2-1, 2-2. The other end of each of the two metal joints 4-1, 4-2 is inserted into a signal line of the first metal shell 5-1 and the second metal shell 5-2 and contacts with a signal terminal thereof, respectively. The first metal shell 5-1 and the second metal shell 5-2 are screwed up so that both ends of the pair of metal fixings 2-1, 2-2 contact with an inner conductor of the first metal shell 5-1 and the second metal shell 5-2. Thus, the shells of the coaxial connector function as a grounding terminal. The contact between the pair of metal fixings 2-1, 2-2 and the inner conductor of the first metal shell 5-1 and the second metal shell 5-2 is not limited to both ends, other contact parts are acceptable. As long as the pair of metal fixings 2-1, 2-2 contacts with the inner conductor of the first metal shell 5-1 and the second metal shell 5-2, the shells function as the grounding terminal.

Figure 2:
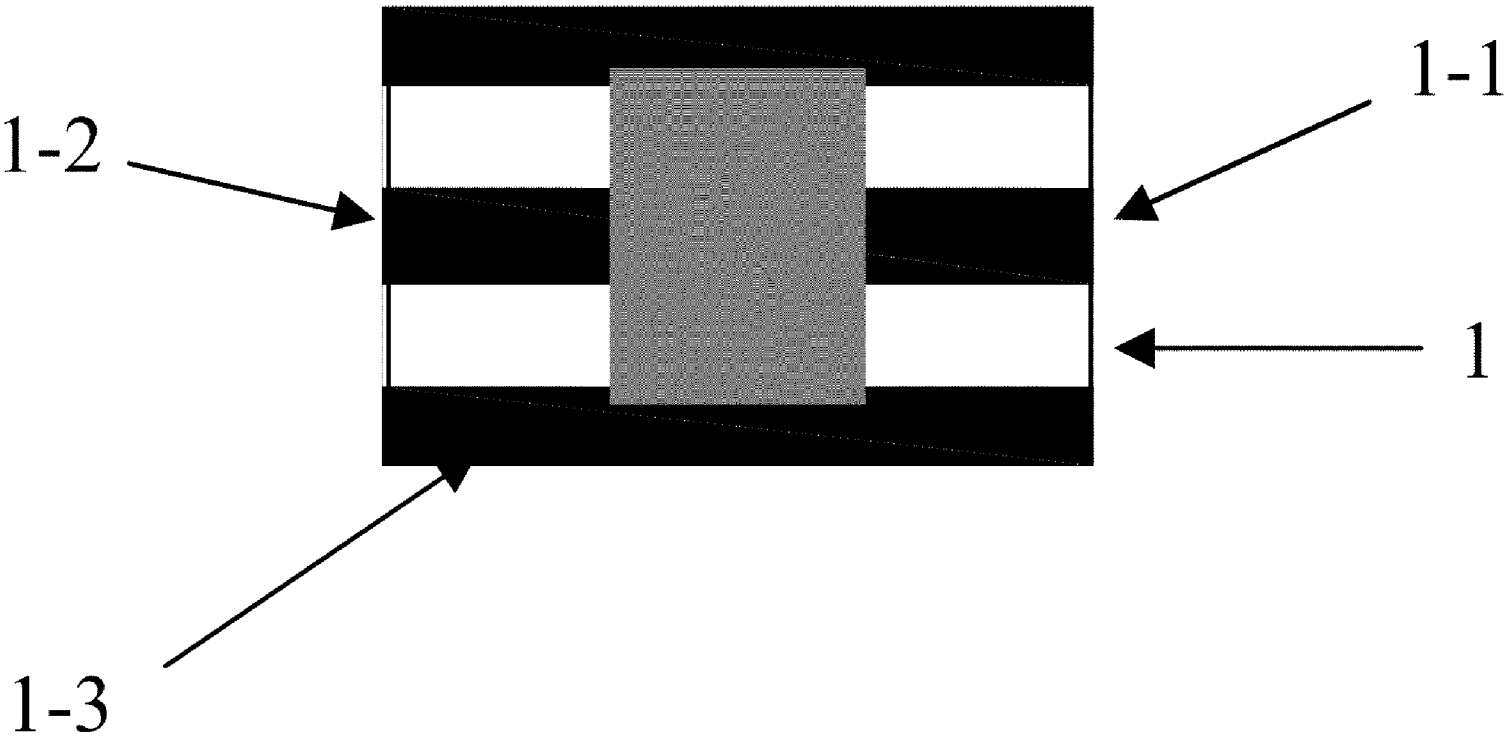
FIG. 2 is a circuit diagram of a first element of a coaxial connector according to one embodiment of the invention.

FIG. 2 shows a circuit diagram of the first element 1 of the coaxial connector. The first element 1 is an attenuator comprising the signal input terminal 1-1, the signal output terminal 1-2, and the grounding terminal 1-3. The attenuator is selected from the group consisting of a Pi attenuator, a T attenuator, a distribution parameter attenuator, and so on. The circuit substrate is a ceramic substrate, a PCB substrate, and so on. Dependent on the frequency range, the ceramic substrate is 0.5 mm, 0.38 mm, 0.25 mm, etc. in thickness. The thinner, the more expensive, and the more difficult to process, but the better the performance. The attenuator may be a thick-film attenuator which is integratedly sintered under high temperature, for example, more than 800° C., or a thin-film attenuator prepared using thin-film technology. The thin-film attenuator has a high working frequency, generally, tens of GHz.

Figure 3:
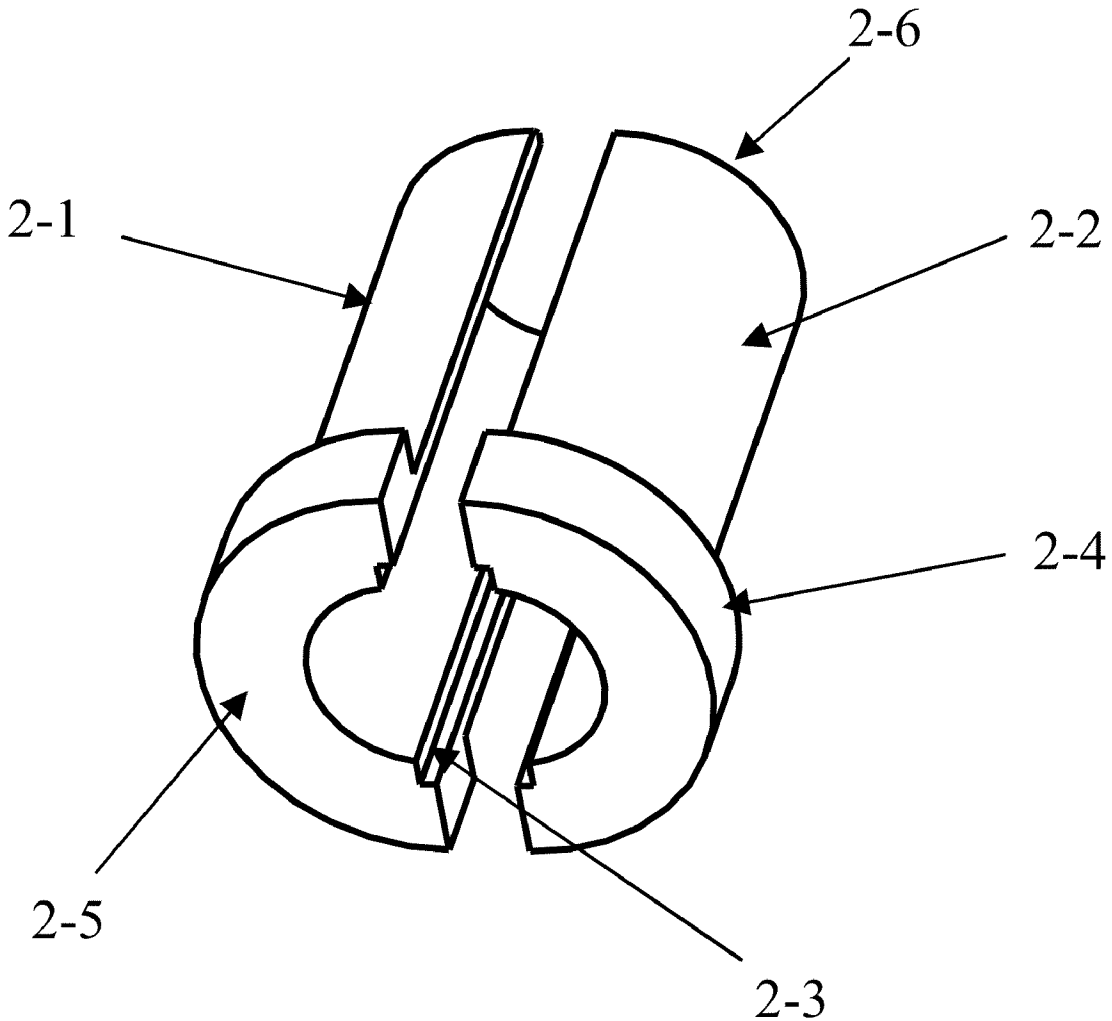
FIG. 3 is a schematic diagram of a pair of metal fixings of a coaxial connector according to one embodiment of the invention.

As shown in FIG. 3, a schematic diagram of the pair of metal fixings 2-1, 2-2 of the coaxial connector. The pair of metal fixings 2-1, 2-2 is hollow and prepared by dividing a hollow cylinder into two halves. The pair of metal fixings 2-1, 2-2 may be a symmetrical structure and comprises a slot (step) 2-3 inside so that the first element 1 can be fixed in the middle symmetrical position thereof. Thus, the two metal joints 4-1, 4-2 can be exactly inserted into the signal line of the first metal shell 5-1 and the second metal shell 5-2, respectively. The thickness of the slot (step) 2-3 should be less than one half that of the circuit substrate of the first element 1, otherwise the grounding cannot be guaranteed or stable. Actually, the slot (step) 2-3 is not indispensable. One end of the pair of metal fixings 2-1, 2-2 comprises a step 2-4 so as to limit the installation location of the elastic fixing member 3. The step 2-4 is not a must. Both ends 2-5, 2-6 of the pair of metal fixings 2-1, 2-2 firmly contact with the inner conductor of the first metal shell 5-1 and the second metal shell 5-2, respectively. The pair of metal fixings 2-1, 2-2 firmly contacts with the first element 1 only at the grounding terminal 1-3 thereof. The pair of metal fixings 2-1, 2-2 sandwiches the first element 1 to ensure the contact between the pair of metal fixings 2-1, 2-2 and the grounding terminal 1-3 of the first element 1. Thus, the grounding is not subject to the thickness of the first element 1 as well as the machining error. The contact between the pair of metal fixings 2-1, 2-2 and the grounding terminal 1-3 of the first element 1 is guaranteed. The pair of metal fixings 2-1, 2-2 can be used for different thickness of substrates, thereby reducing the stocks of elements, and the assembling and disassembling of the substrate is easy, without destroying the circuit substrate. The pair of metal fixings 2-1, 2-2 includes but is not limited to a hollow cylinder, which may be prepared by dividing a hollow square cylinder or a hollow polygonal cylinder into two halves. Preferably, the pair of metal fixings 2-1, 2-2 is made of red copper which has a little elasticity and good electric conductivity, and is easy to contact. Actually, other metal materials, for example, brass, are also practicable.

Figure 4:
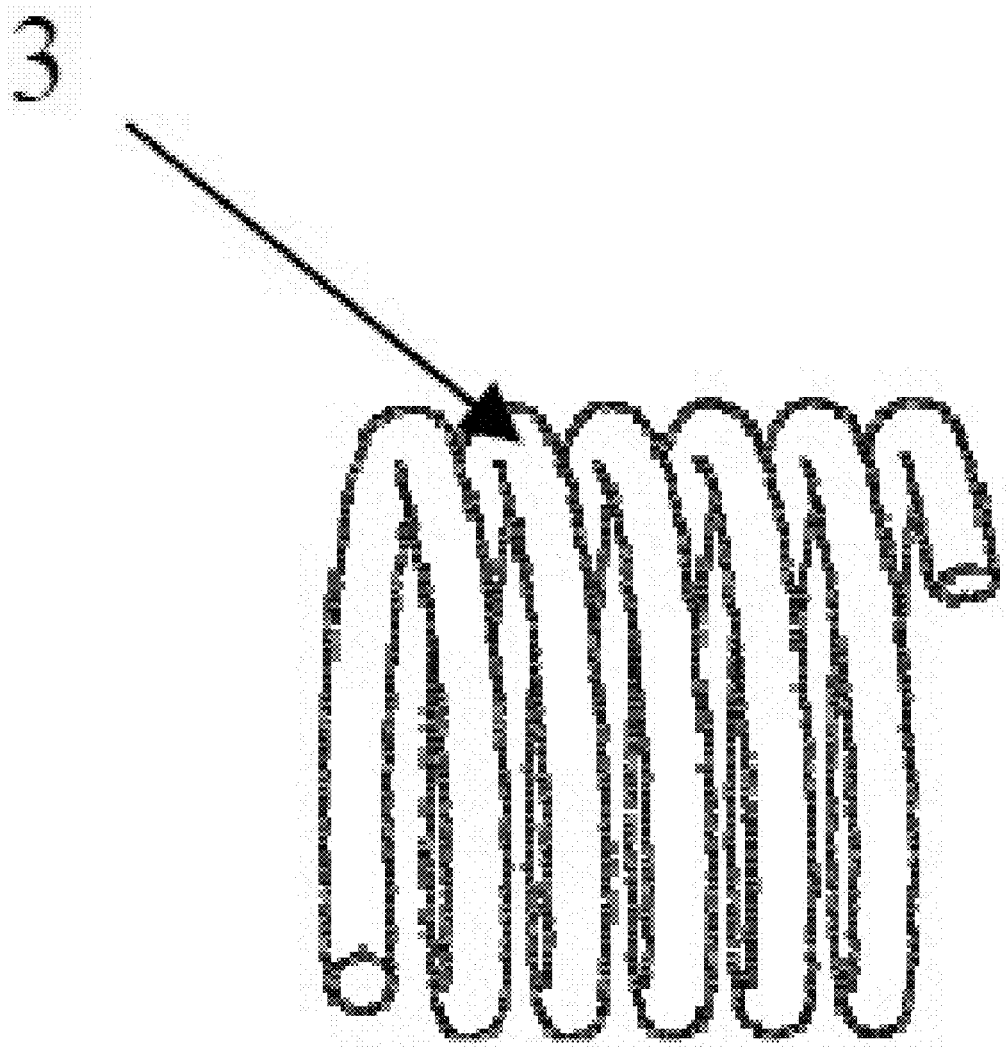
FIG. 4 is a schematic diagram of an elastic fixing member of a coaxial connector according to one embodiment of the invention.

As shown in FIG. 4, a schematic diagram of the elastic fixing member 3 of the coaxial connector. The elastic fixing member 3 is a spring which firmly embraces the pair of metal fixings 2-1, 2-2 to guarantee the firm contact between the pair of metal fixings 2-1, 2-2 and the grounding terminal 1-3 of the first element 1. Due to large elasticity, one spring is practicable for different thickness of ceramic substrates, e.g., 0.5 mm, 0.38 mm, and 0.25 mm. Optionally, the elastic fixing member 3 is a spring leaf (arc in shape) or a silica gel with high temperature resistance, or other elastomers with capacity of strengthening or tightening. The application of the spring leaf need make a new mold, thereby increasing the production cost.

Figure 5:
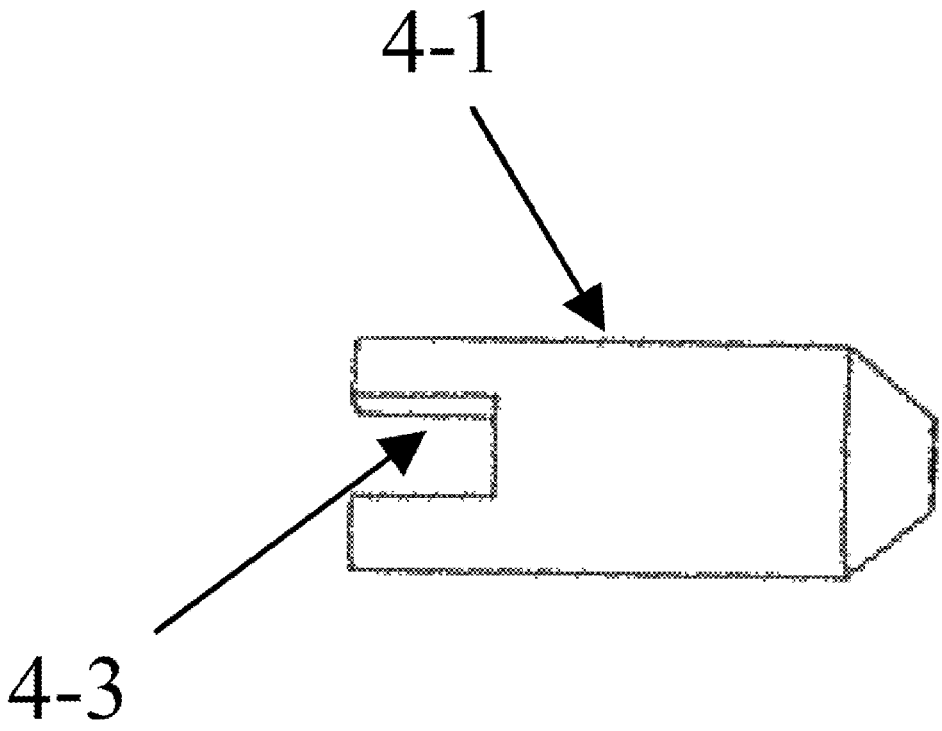
FIG. 5 is a schematic diagram of a metal joint of a coaxial connector according to one embodiment of the invention.

As shown in FIG. 5, a schematic diagram of the metal joint 4-1 of the coaxial connector. One end of the metal joint 4-1 comprises a groove 4-3 which contacts with the signal terminal of the first element 1, and thus the metal joint 4-1 can be soldered to the signal terminal of the first element 1. The groove 4-3 is not a must. For example, an electrode is separately disposed at the side of the signal input terminal 1-1 and the signal output terminal 1-2 of the first element 1, and when the first metal shell 5-1 and the second metal shell 5-2 are screwed up, the metal joint 4-1 contacts with the first element 1 by electrical contact. Particularly when the frequency exceeds tens of GHz, the electrical contact exhibits obvious advantages. The metal joint 4-2 has the same structure as the metal joint 4-1.

Figure 6:
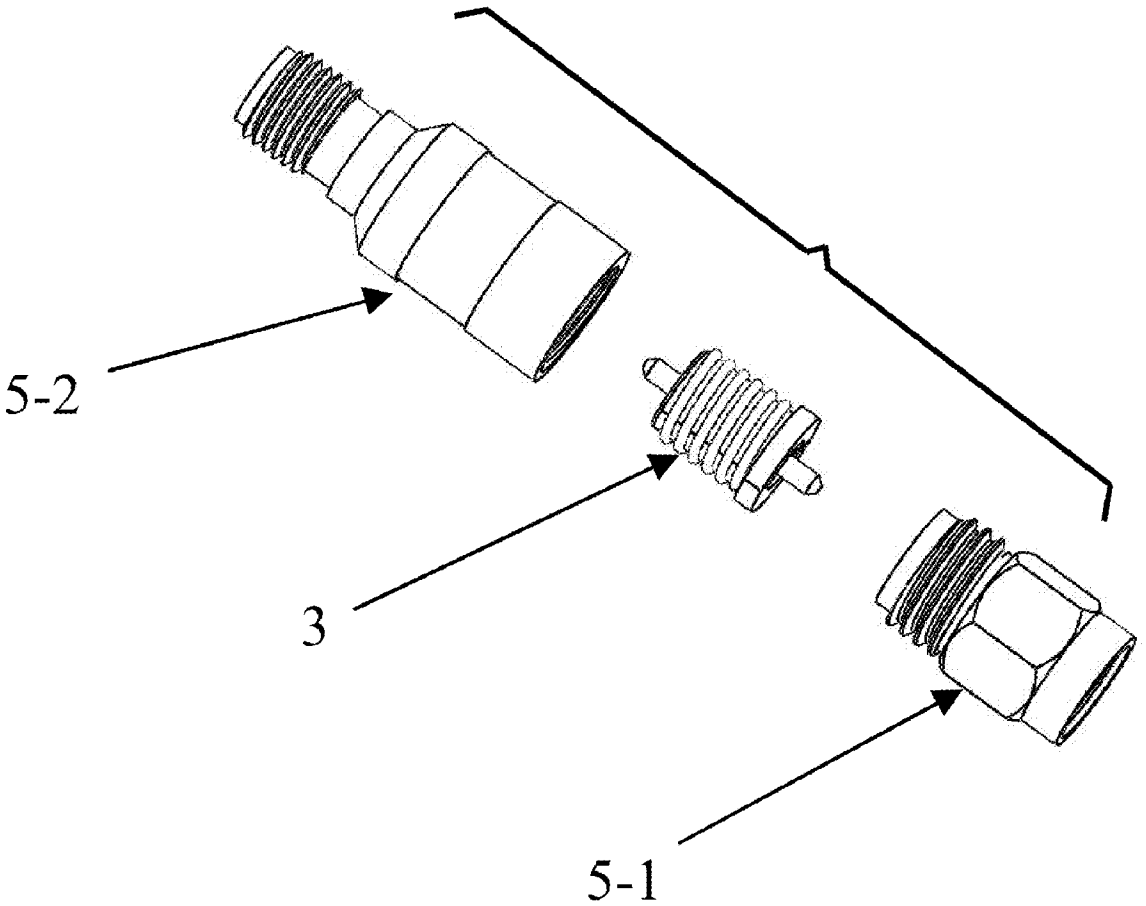
FIG. 6 is a schematic diagram of a first metal shell and a second metal shell of a coaxial connector according to one embodiment of the invention.

As shown in FIG. 6, a schematic diagram of the first metal shell 5-1 and the second metal shell 5-2 of the coaxial connector. The first metal shell 5-1 comprises screw thread which cooperates with internal screw thread of the second metal shell 5-2, so that the first element 1, the metal joints 4-1, 4-2, the pair of metal fixings 2-1, 2-2, and the elastic fixing member 3 are firmly fixed in the shells.

Figure 7:
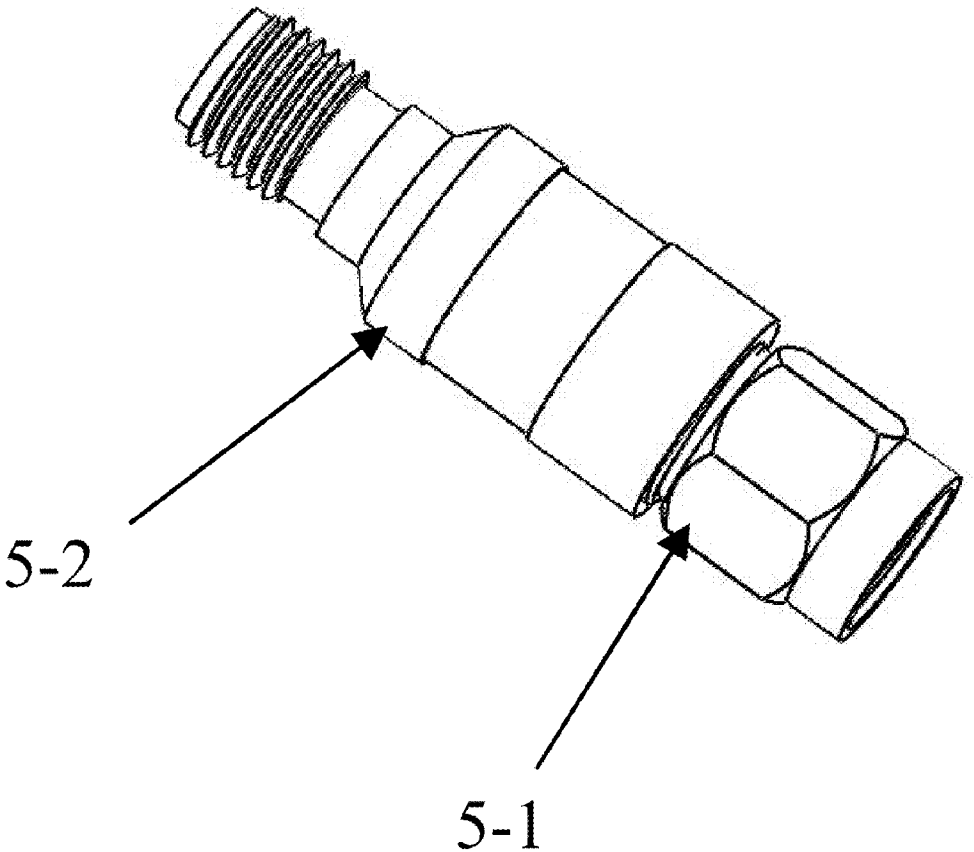
FIG. 7 is an external view of a coaxial connector according to one embodiment of the invention.

FIG. 7 shows an external view of a SMA-type coaxial connector. Optionally, the coaxial connector may be an N-type coaxial connector, BNC-type coaxial connector, F-type coaxial connector, SMB-type coaxial connector, SSMA-type coaxial connector, or something like that. Although coaxial devices made of the above mentioned coaxial connector may have different external shapes, the internal structures thereof are the same.

Figure 8:
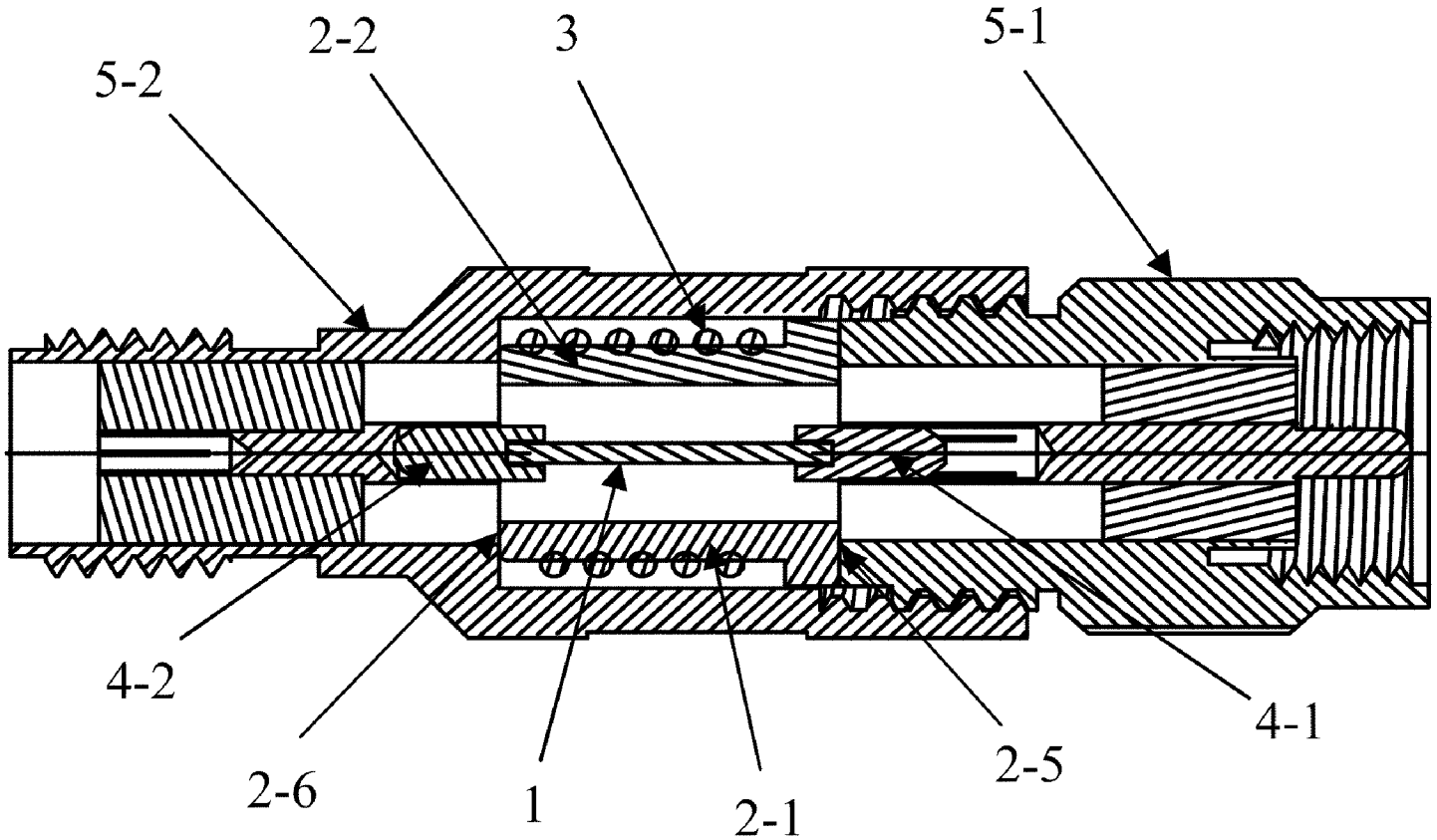
FIG. 8 is a sectional view of a coaxial connector according to one embodiment of the invention.

FIG. 8 shows a sectional view of the coaxial connector. By screwing up the first metal shell 5-1 and the second metal shell 5-2, both ends 2-5, 2-6 of the pair of metal fixings 2-1, 2-2 firmly contact with the inner conductor of the first metal shell 5-1 and the second metal shell 5-2, respectively, thereby ensuring the common-ground link of the grounding terminal 1-3 of the first element 1 with the external signals. The pair of metal fixings 2-1, 2-2 is suitable for different thickness of substrates. The assembling and disassembling of the device is easy, the grounding is secure, and thus high accuracy and high electrical performance of coaxial connectors are achieved. The device is particularly suitable for the preparation of fixed attenuator with different frequency range.

Figure 9:
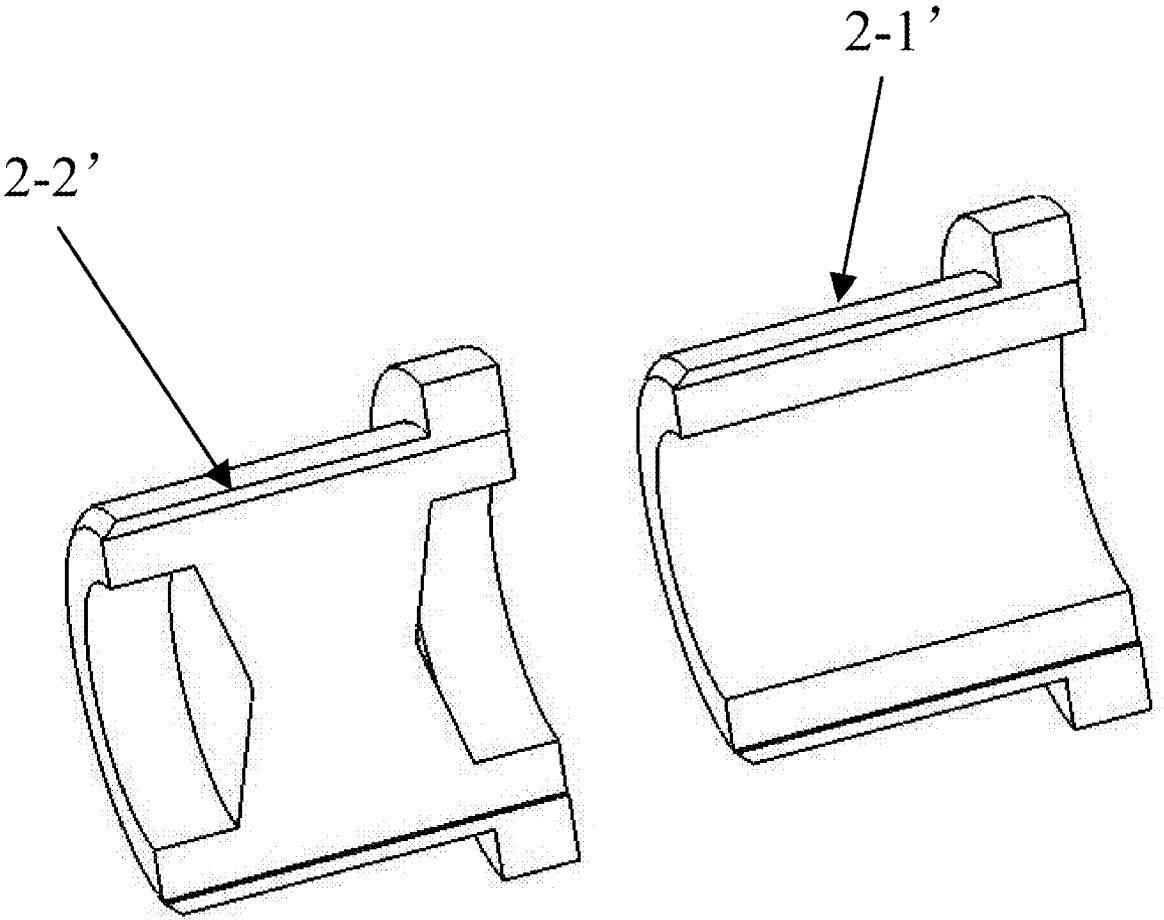
FIG. 9 is a schematic diagram of a pair of metal fixings of a coaxial connector according to one embodiment of the invention.

The pair of metal fixings 2-1, 2-2 is not necessarily hollow. As shown in FIG. 9, one metal fixing 2-1' is hollow, while the other metal fixing 2-2' is solid in the middle and hollow at both ends. Upon assembling, the circuit substrate of the first element 1 is attached to the solid part of the metal fixing 2-2', which, on the one hand, ensures the grounding of the first element 1, on the other hand, benefits the heat produced by the first element 1 to dissipate along the metal fixing 2-2', thereby prolonging the service life of the first element 1.

Advantages of the invention are summarized below. The pair of metal fixings 2-1, 2-2 of the coaxial connector is practicable for different thickness of substrates, thereby reducing the stocks of elements. The assembling and disassembling of the device is easy, the grounding is secure, and thus high accuracy and high electrical performance of coaxial connectors are achieved. The device is particularly suitable for the preparation of fixed attenuator with different frequency range.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A coaxial connector, comprising a) a first element comprising a circuit substrate, a signal input terminal, a signal output terminal, and a grounding terminal;

b) two metal joints;

c) a first metal shell;

d) a second metal shell;

e) an elastic fixing member; and f) a pair of metal fixings;

wherein said first element is sandwiched between said pair of metal fixings, and said grounding terminal contacts with said pair of metal fixings;

said elastic fixing member embraces said pair of metal fixings;

one end of each of said two metal joints contacts with said signal input terminal and said signal output terminal of said first element, respectively, and the other end thereof contacts with a signal terminal of said first metal shell and said second metal shell, respectively; and said pair of metal fixings both contact with an inner conductor of said first metal shell and said second metal shell.

2. The coaxial connector of claim 1, wherein said pair of metal fixings is hollow.

3. The coaxial connector of claim 2, wherein said pair of metal fixings in combination is a hollow cylinder.

4. The coaxial connector of claim 1, wherein one metal fixing is hollow, while the other metal fixing is solid in the middle and hollow at both ends, and said circuit substrate of said first element is attached to a solid part of said metal fixing.

5. The coaxial connector of claim 1, wherein said first element is an attenuator, a wave filter, an impedance converter.

6. The coaxial connector of claim 5, wherein said attenuator is a thick-film attenuator integratedly sintered under high temperature or a thin-film attenuator.

7. The coaxial connector of claim 1, wherein a groove is disposed at one end of said metal joint to contact with said signal terminal of said first element.

8. The coaxial connector of claim 1, wherein said two metal joints are soldered to said signal input terminal and said signal output terminal of said first element, respectively.

9. The coaxial connector of claim 1, wherein an electrode is separately disposed at the side of said signal input terminal and said signal output terminal of said first element.

10. The coaxial connector of claim 1, wherein said elastic fixing member is a spring, a spring leaf, or a silica gel with high temperature resistance.

11. The coaxial connector of claim 1, wherein a step is disposed at one end of said pair of metal fixings to limit the installation location of said elastic fixing member.

12. The coaxial connector of claim 1, being an SMA-type coaxial connector, N-type coaxial connector, BNC-type coaxial connector, F-type coaxial connector, SMB-type coaxial connector, or SSMA-type coaxial connector.

* * * * *